US008181355B2

(12) United States Patent
Geyer et al.

(10) Patent No.: US 8,181,355 B2
(45) Date of Patent: May 22, 2012

(54) LAUNDRY DRUM

(75) Inventors: Johannes Geyer, Haar (DE); Uwe Ratfisch, Berlin (DE); Stephan Sommer, Falkensee (DE); Wilfried Wildung, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 942 days.

(21) Appl. No.: 12/087,133

(22) PCT Filed: Dec. 5, 2006

(86) PCT No.: PCT/EP2006/069310

§ 371 (c)(1),
(2), (4) Date: Jun. 26, 2008

(87) PCT Pub. No.: WO2007/077075

PCT Pub. Date: Jul. 12, 2007

(65) Prior Publication Data

US 2011/0088276 A1 Apr. 21, 2011

(30) Foreign Application Priority Data

Dec. 28, 2005 (DE) ..... 10 2005 062 803
Mar. 6, 2006 (DE) ..... 10 2006 010 179

(51) Int. Cl.

| | |
|---|---|
| ***F26B 17/30*** | (2006.01) |
| ***D06F 58/00*** | (2006.01) |
| ***D06F 21/00*** | (2006.01) |
| ***D06F 27/00*** | (2006.01) |
| ***D06F 29/00*** | (2006.01) |
| ***D06F 21/04*** | (2006.01) |

(52) U.S. Cl. ..... 34/58; 34/108; 68/142; 68/147; 68/24; 68/58

(58) Field of Classification Search ..... 34/108, 34/595, 596, 602, 58, 142, 24, 147, 23.4; 68/58, 142, 143, 24, 139, 19, 124
See application file for complete search history.

(56) References Cited

U.S. PATENT DOCUMENTS

| | | | | |
|---|---|---|---|---|
| 5,881,909 | A * | 3/1999 | Crain et al. | 220/676 |
| 6,334,341 | B1 * | 1/2002 | Hellhake et al. | 68/124 |
| 2005/0132556 | A1 * | 6/2005 | Bobed | 29/505 |
| 2005/0283920 | A1 * | 12/2005 | Wittemann | 8/158 |

FOREIGN PATENT DOCUMENTS

| | | |
|---|---|---|
| DE | 196 03 710 | 8/1997 |

(Continued)

*Primary Examiner* — Kenneth Rinehart
*Assistant Examiner* — John McCormack
(74) *Attorney, Agent, or Firm* — James E. Howard; Andre Pallapies

(57) ABSTRACT

A laundry drum for a laundry treatment machine mounted within a housing for rotation about a non-vertical axis, the laundry drum including a drum casing having a plurality of stamped recesses formed therein in a manner such that at least one sectional plane of the laundry drum lying at right angles to the axis of rotation has an at least approximately circular shape, the laundry drum including a drum casing having the curved stamped recesses formed therein in a manner wherein in the alignment of a surface contour lying in the drum casing is formed a surface having a plurality of arcuate edges which merge continuously into one another with a single axis of symmetry extending at least approximately in the circumferential direction of the drum casing.

20 Claims, 3 Drawing Sheets

Figure 1:
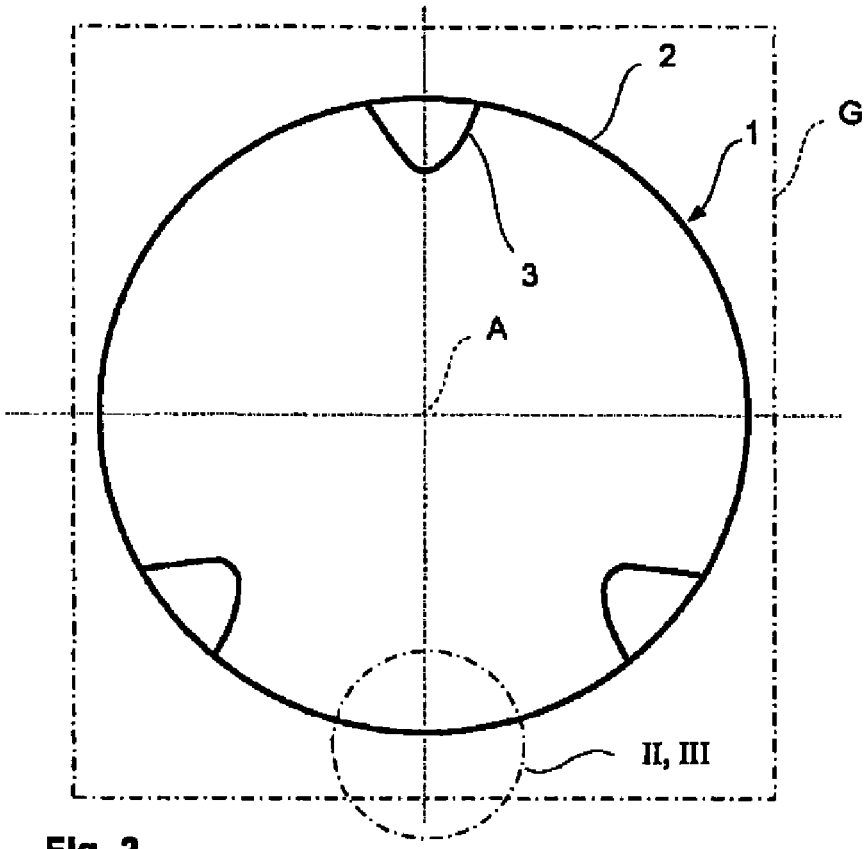

FOREIGN PATENT DOCUMENTS * cited by examiner

| | | | | |
|---|---|---|---|---|
| DE | 199 51 743 | | | 5/2001 |
| DE | 19951743 | A1 | * | 5/2001 |
| DE | 101 62 918 | | | 7/2003 |
| WO | WO03054275 | A | * | 12/2001 |
| WO | WO 03/054275 | | | 7/2003 |

Fig. 6
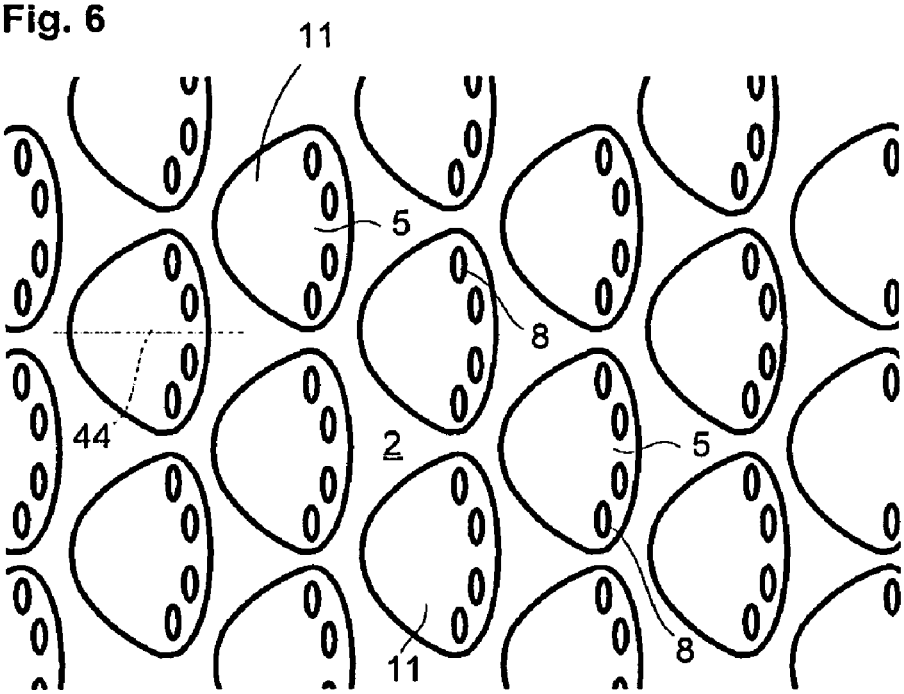
Fig. 7
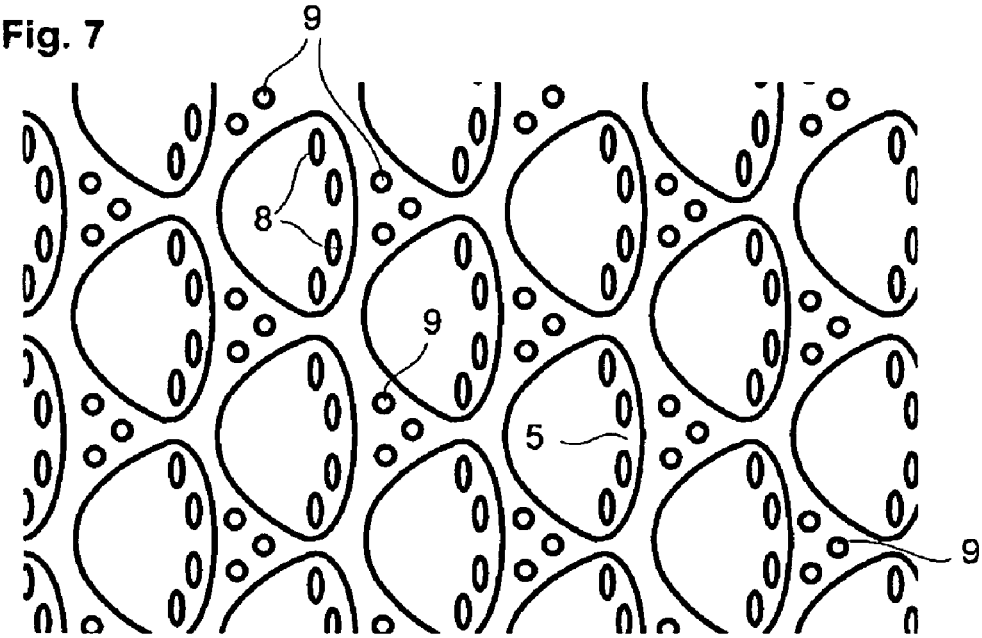
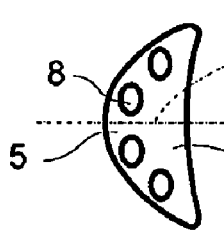
Fig. 8

LAUNDRY DRUM

The invention relates to a laundry drum for a laundry treatment machine which is mounted inside a housing such that it can rotate about an axis which is not oriented in the direction of gravity and has a drum casing which is bent in this way and is provided with stamped recesses so that at least one cross-sectional plane of the laundry drum lying at right angles to the axis of rotation has an approximately circular shape.

A laundry drum of this type is known from WO 98/20195. Its stamped recesses have a contour surface in the shape of a regular polygon, for example a regular hexagon. In this case the side edges of these contour surfaces strike against each other and provided in the shared corners of the contour surfaces are small surfaces lying in alignment with the drum casing into which solely flood holes are cut. These measures are intended on the one hand to intensify the mechanical treatment the laundry and on the other hand to make a greater contribution to protecting the laundry. The significantly smaller number and the likewise smaller individual cross section of the flood holes reduce the overall flood hole surface of such a drum casing, so that exchange of liquid between the Inner and the outer area of such a laundry drum is then visibly significantly reduced. This adversely affects the washing and rinsing action since the throughflow of lye drops.

The object of the invention is to embody a laundry drum as defined at the start of this document so that, for mechanical treatment of the laundry which is actually more intensive, the throughflow power of the drum casing is increased without any reduction having to be accepted in the protection afforded to the laundry.

This object is achieved inventively by the drum casing being provided with curved stamped recesses, of which the contour which lies in alignment with the drum casing forms a surface with a number of arcuate edges which merge continuously into one another and only has only one axis of symmetry which extends at least approximately in the circumferential direction of the drum casing. This embodiment of the drum casing means that there are no corners on the stamped recess contours which run into each other and in which disruptive flood holes sit. Furthermore the continuously merging arcuate delimited contour surfaces lead to gentle handling of the laundry. This applies most strongly in the inwards-pointing position of the stamped recesses adopted in accordance with claim 2.

In accordance with an advantageous further development of the invention (claim 3) the contour of each stamped recess forms a teardrop-shaped area. The axes of symmetry running in the circumferential direction of the drum casing extend stamped recesses formed in this way in the direction of movement of the drum, so that flow flowing past the stamped recesses supports the exchange of soiling in a washing machine from inside to outside and back through the flood holes if these stamped recesses are developed in accordance with claim 6 such that flood holes are arranged in a part of the curved surface of each stamped recess sloping as steeply as possible in relation to the drum casing.

This development however also produces a similarly good effect if, in accordance with claim 4 the contour of each stamped recess forms a conchiform area or in accordance with claim 5 a sickle-shaped area.

The good throughflow can however be further increased if the invention is developed in accordance with claim 7 and the casing surface between the stamped recesses features flood holes.

All features of the developments of the invention described in the subclaims can be used with each other and with the features of claim 1.

The invention is explained in greater detail below on the basis of the exemplary embodiments shown in the drawing. The figures shown in the drawing are as follows FIG. 1 a laundry treatment machine with a drum supported horizontally along a plane running at right angles to the axis of rotation, FIG. 2 a section of a drum casing enlarged in the sectional plane shown in accordance with detail II in FIG. 1 with stamped recesses curved inwards, FIG. 3 a drum casing section corresponding to detail III in FIG. 2 with a stamped recess curved outwards, FIG. 4 a view from inside of the drum casing section shown in FIG. 2 with a teardrop-shaped stamped recess, FIG. 5 a view as depicted in FIG. 4 with additionally inserted flood holes, FIG. 6 a view from inside the drum casing depicted in FIG. 2 with a conchiform stamped recess, FIG. 7 a view as depicted in FIG. 6 with additionally inserted flood holes and FIG. 8 a view from inside of sickle-shaped stamped recess in the drum casing section depicted in FIG. 2.

The drum 1 shown in cross-section in FIG. 1 has a drum casing 2 enclosing it and washing tumblers 3 arranged on its inside. It is supported to allow it to rotate in a housing G around at least an approximately horizontal axis A and together with the housing G and if necessary together with a lye holder which encloses it but is not shown in the diagram forms a laundry treatment machine. This can be a drum washing machine or a drum dryer. Stamped recesses are made on the surface of the drum casing 2, these being explained in detail on the basis of FIGS. 2 to 8. To this end, variants for stamped recesses in the drum casing of the detail II or II in FIG. 1 are shown on the basis of the enlarged sections depicted in FIGS. 2 and 3.

Figure 2:
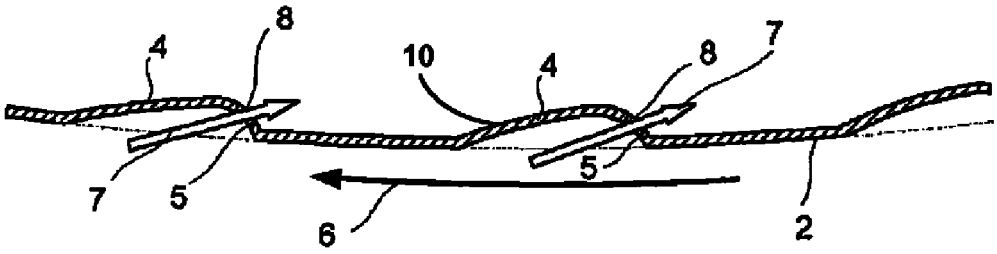

With the drum casing 2 shown in FIG. 2 the stamped recesses 4 are curved into the inner chamber of the drum. Arranged at a part 5 of the stamped recesses 4 with a steep edge against the drum casing 2 are flood holes 8 through which, in the specified direction of rotation 6 lye penetrates on the path described by the arrows 7 from outside into the drum 1. The flat parts of the stamped recesses 4 sloping down against the drum casing 2 are used to guide the lye in the most laminar possible manner on the drum casing 2 in towards the flood holes 8 arranged in the steep part 5 which means that the greatest possible flow pressure is produced in front of the holes, which forces a significant proportion of the lye through the holes and thereby improves the flooding of the washing located in the laundry drum. In addition the edges inclined at different angles 5 and 10 of the stamped recesses protruding into the laundry drum 1 with an adapted rhythm of the laundry drum in the respective left or right direction of rotation make it possible to control the mechanical entry onto the washing while it is being handled.

Figure 3:
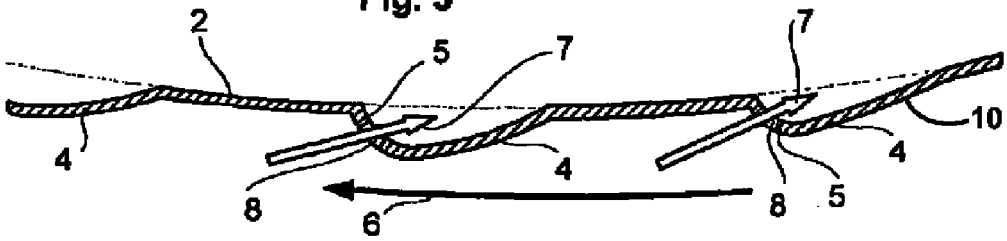
Figure 4:
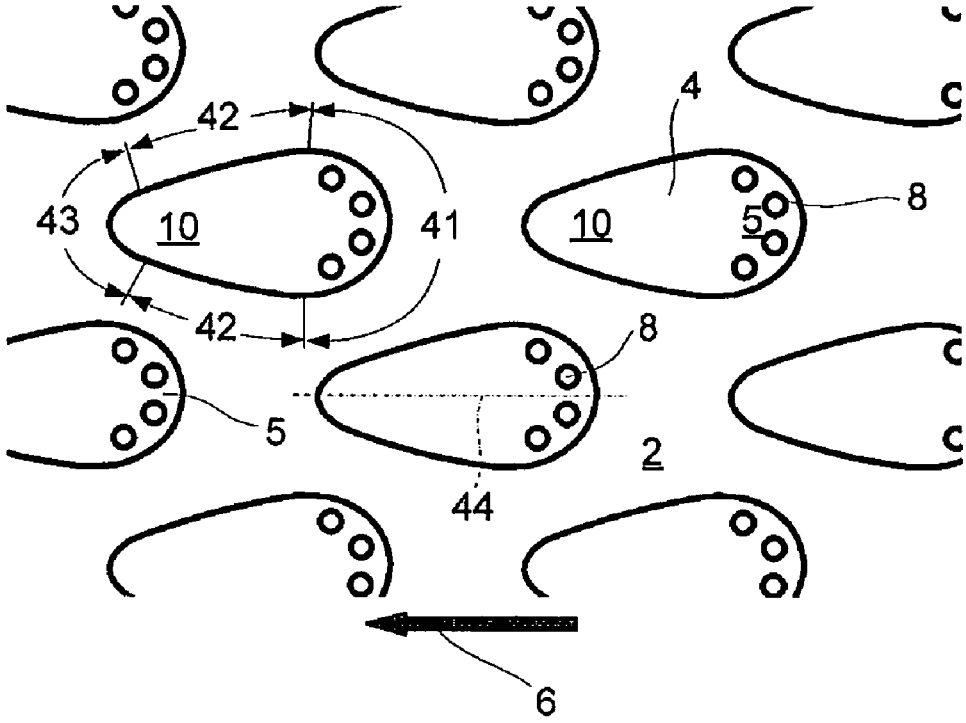

By contrast the stamped recesses 4 in the drum casing 2 of FIG. 3 are directed outwards and likewise have steep parts 5 of the curved surface which are directed in the specified direction of rotation 6 against the flow of lye 7 acting from the outside. This means that the lye will enter through the flood holes 8 and reach the inside of the laundry drum 1. The arrangements depicted in FIG. 2 or 3 enable a significant lye flow to be achieved which is necessary for ensuring good flooding of the washing in the drum.

Seen from the inside of the drum casing 2, a diagram as shown in FIG. 4 to 7 or 8 respectively is produced for different variants of the embodiment of stamped recesses 4 and flood holes 8 or 9.

A drum casing 2 in accordance with the invention can for example be stamped as shown in FIG. 4, in which teardrop-shaped stamped recesses 4 are described. Flood holes are made in the steep parts 5 of the curved surfaces of the stamped recesses 4 as depicted in FIG. 2 or 3, so with the stamped recesses 4 which protrude from the plane of the drawing in direction of the narrow parts 10 of the stamped recesses, namely in the direction of arrow 6, the drum casing 2 has to move so that the lye can penetrate from outside into the interior of the drum.

Figure 5:
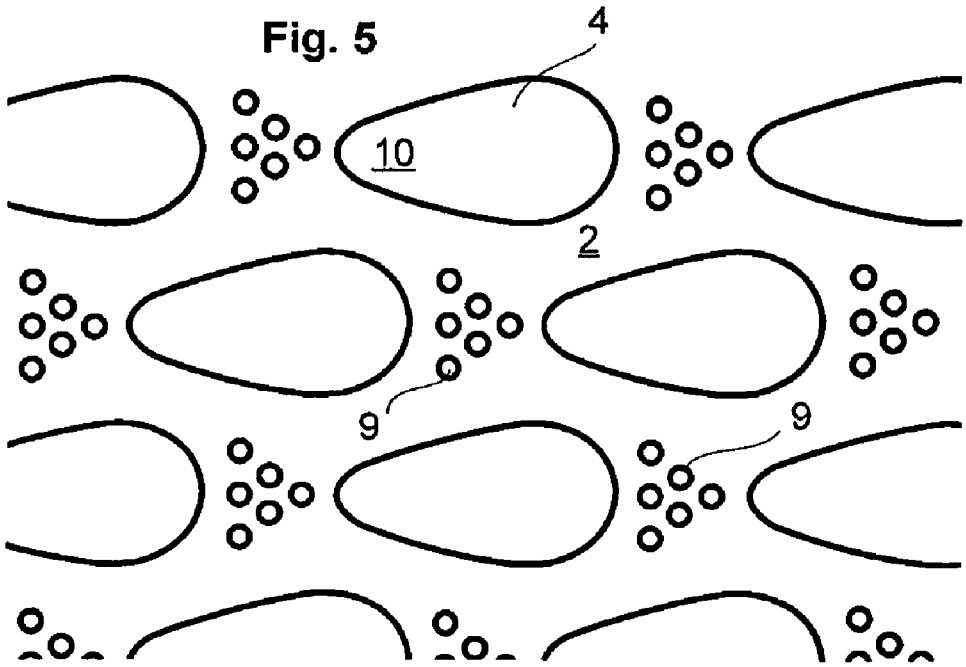

Instead of or in addition to the flood holes 8, in accordance with FIG. 5 flood holes can also be made in the flat sections of the drum casing 2 between the stamped recesses 4. Here lye penetrates from outside so that the lye drawn through the stamped recesses 4 made in a lye holder surrounding the drum lead to a wave-form pressure formation of which the pressure peaks meet at the flood holes. In addition these flood holes naturally also serve, as with usual laundry drums, for the exchange of lye from inside to outside and vice versa.

In FIGS. 6 and 7 arrangements similar to those depicted in FIGS. 4 and 5 are made by means of conchiform stamped recesses 11. Here too flood holes 8 are arranged in the steep parts 5 of the stamped recesses 11, which, with an appropriate direction of rotation of the drum, as shown by the direction of the arrow 6 in FIG. 4, lead to lye flowing into the drum, as described for the stamped recesses in accordance with FIG. 2. Additional flood holes 9 in accordance with FIG. 7 can naturally also be inserted.

By way of illustration FIG. 8 shows a further shape for stamped recesses 12. This shape is the same as or similar to that of a sickle, which also leads to an irregular curvature of the stamped recesses 12 and has a steep part 5, in which flood holes 8 can be arranged. In addition a stamped recess 12 of this shape can basically be used in the same sense and arranged like the other shapes for the stamped recesses 4 and 11.

The exemplary embodiments shown do not represent a finite number of variants. The features of claim 1 can conceivably also include other forms of stamped recess which are not directly addressed here. The different shapes can also be mixed with one another. Variants are even conceivable in which the stamped recesses in accordance with the invention or their developments are mixed with stamped recesses which can be found in the prior art.

An inventive laundry drum not only improves the handling of the laundry, as has already been described above. It is also more stable than a laundry drum without stamped recesses. In addition a drum casing stamped in the inventive manner tends to be less susceptible to membrane-type vibrations, so that it has acoustic advantages compared to non-stamped laundry drums. It is also pointed out that a laundry treatment machine can also be a tumble dryer, in which, if not required for air circulation, corresponding holes in or next to den stamped recesses such as the flood holes in the washing machine-laundry drum can be dispensed with entirely.

The invention claimed is:

1. A laundry drum for a laundry treatment machine mounted within a housing for rotation about a non-vertical axis thereby defining an axis of rotation, the laundry drum comprising:

a drum casing having a surface extending in a circumferential direction of the drum casing;

a plurality of curved stamped recesses formed in the surface of the drum casing by a plurality of arcuate edges which merge continuously into one another, wherein each curved stamped recess has only one axis of symmetry, the axis of symmetry extends at least approximately in the circumferential direction of the drum casing, and symmetry around the axis of symmetry is established with regard to only the curved stamped recess and without regard to any flood holes that may exist in the curved stamped recess.

2. The laundry drum according to claim 1 wherein the stamped recess is curved inwardly with respect to the axis of drum rotation.

3. The laundry drum according to claim 1 wherein the contour of each stamped recess forms a teardrop-shaped curved surface.

4. The laundry drum according to claim 1 wherein the contour of each stamped recess forms a conchiform curved surface.

5. The laundry drum according to claim 1 wherein the contour of each stamped recess forms a sickle-shaped curved surface.

6. The laundry drum according to claim 1 wherein the curved surface of each stamped recess when viewed in a cross section along its axis of symmetry features a portion rising steeply in relation to the drum casing and a flat portion sloping downwardly in relation to the drum casing.

7. The laundry drum according to claim 6 and further comprising flood holes formed in the part of the curved surface of each stamped recess rising steeply in relation to the drum casing for subjecting items to be washed to a wet process.

8. The laundry drum according to claim 1 wherein the casing surface between the stamped recesses includes flood holes formed therein.

9. The laundry drum according to claim 1 and further comprising flood holes formed in each stamped recess for subjecting items to be washed to a wet process.

10. The laundry drum according to claim 9 wherein the casing surface between the stamped recesses includes flood holes formed therein.

11. A laundry drum for a laundry treatment machine mounted within a housing for rotation about a non-vertical axis thereby defining an axis of rotation, the laundry drum including a drum casing having a plurality of stamped recesses formed therein in a manner such that at least one sectional plane of the laundry drum lying at right angles to the axis of rotation has an at least approximately circular shape, the laundry drum comprising a drum casing having the curved stamped recesses formed therein in a manner wherein in the alignment of a surface contour lying in the drum casing is formed a surface having a plurality of arcuate edges which merge continuously into one another such that each of the curved stamped recesses has only one axis of symmetry, wherein the axis of symmetry extends at least approximately in the circumferential direction of the drum casing, and symmetry around the axis of symmetry is established with regard to only the curved stamped recess and without regard to any flood holes that may exist in the curved stamped recess.

12. The laundry drum according to claim 11 wherein the stamped recess is curved inwardly with respect to the axis of drum rotation.

13. The laundry drum according to claim 11 wherein the contour of each stamped recess forms a teardrop-shaped curved surface.

14. The laundry drum according to claim 11 wherein the contour of each stamped recess forms a conchiform curved surface.

15. The laundry drum according to claim 11 wherein the contour of each stamped recess forms a sickle-shaped curved surface.

16. The laundry drum according to claim 11 wherein the curved surface of each stamped recess when viewed in a cross section along its axis of symmetry features a portion rising steeply in relation to the drum casing and a flat portion sloping downwardly in relation to the drum casing.

17. The laundry drum according to claim 16 and further comprising flood holes formed in the part of the curved surface of each stamped recess rising steeply in relation to the drum casing for subjecting items to be washed to a wet process.

18. The laundry drum according to claim 11 wherein the casing surface between the stamped recesses includes flood holes formed therein.

19. The laundry drum according to claim 11 and further comprising flood holes formed in each stamped recess for subjecting items to be washed to a wet process.

20. The laundry drum according to claim 19 wherein the casing surface between the stamped recesses includes flood holes formed therein.

* * * * *